US005945620A

United States Patent [19]

Adamson

[11] Patent Number: 5,945,620

[45] Date of Patent: Aug. 31, 1999

[54] DIGITAL TONE GENERATOR FOR PRODUCING PHASE SYNCHRONIZED TONES

[75] Inventor: John P. Adamson, Allentown, Pa.

[73] Assignee: Allen Organ Company, Macungie, Pa.

[21] Appl. No.: 09/039,966

[22] Filed: Mar. 16, 1998

[51] Int. Cl.[6] ..... G10H 1/18; G10H 7/00

[52] U.S. Cl. ..... 84/615; 84/620

[58] Field of Search ..... 84/613, 653, 620, 84/686

[56] References Cited

U.S. PATENT DOCUMENTS

| | | | |
|---|---|---|---|
| 4,131,049 | 12/1978 | Okumura et al. . | |
| 4,177,706 | 12/1979 | Greenberger . | |
| 4,224,856 | 9/1980 | Ando et al. . | |
| 4,384,504 | 5/1983 | Deforeit . | |
| 4,386,546 | 6/1983 | Fritz et al. | 84/653 X |
| 4,711,148 | 12/1987 | Takeda et al. . | |
| 5,119,710 | 6/1992 | Tsurumi et al. | 84/615 |
| 5,189,238 | 2/1993 | Hayakawa | 84/615 X |
| 5,200,565 | 4/1993 | Satoshi et al. . | |

*Primary Examiner*—Jeffrey W. Donels
*Attorney, Agent, or Firm*—Seidel Gonda, Lavorgna & Monaco, PC

[57] ABSTRACT

The present invention provides an apparatus and method for phase synchronizing tones in an electronic musical instrument. The apparatus includes a microprocessor having an input for receiving a signal representative of a selected note whereupon receipt of the signal, the microprocessor checks a set of available ranks to determine which of the available ranks is associated with the selected note. The apparatus further includes an oscillator which is established for each rank determined to be associated with the selected note such that each oscillator includes initializing parameters and initiating parameters which define the selected note and the associated rank. The apparatus also includes a plurality of tone engines for generating tones. The tone engines are coupled to each oscillator wherein the initializing parameters are transferred from each oscillator to an associated one of the plurality of tone engines and then the initiating parameters are simultaneously transferred from each oscillator to the associated tone engine. The method of the present invention includes receiving a signal representative of a selected note and monitoring a set of available ranks to determine which of the available ranks are associated with the selected note. Upon determining the rank associated with the selected note, establishing an oscillator for each such determined rank wherein the oscillator includes initializing parameters and initiating parameters for defining a tone of the selected note and the associated rank. The initializing parameters are transferred from each established oscillator to an associated tone engine for generating the tone whereafter the initiating parameters are transferred from each established oscillator to the associated tone engine.

15 Claims, 8 Drawing Sheets

DIGITAL TONE GENERATOR FOR PRODUCING PHASE SYNCHRONIZED TONES

FIELD OF THE INVENTION

The present invention is directed generally to the generation of tones in electronic musical instruments. More specifically, the present invention is related to generating digital tones for electronic musical instruments which are phase synchronized.

BACKGROUND OF THE INVENTION

The present invention is particularly adaptable for use in electronic organs. The term "organ" is used throughout the specification to include any electronic musical instrument having a keyboard, such as electronic organs, electric pianos, and accordions. The principles of the present invention are, in fact, applicable to any musical instrument in which musical sounds are generated in response to the actuation of key switches regardless of whether those switches are actuated directly, i.e., by the musician's fingers, or indirectly, e.g., by the plucking of strings. The term "key" includes depressible levers, actuable on-off switches, touch- or proximity-responsive (e.g, capacitance- or inductance-operated) devices, closeable apertures (e.g., a hole in a "keyboard" of holes which, when covered, closes or opens a fluidic circuit to produce a tonal response), and so forth.

The function of an electronic organ is to faithfully reproduce, or simulate by electronic means, the sounds or tones developed by a true pipe organ in response to playing of the organ by the organist a selection of notes, and voices and other characteristics of those notes. Generally, true pipe organs are out of reach of the public because of their substantial expense and size. Thus, electronic organs have been developed as a substitute which is more readily available.

Electronic musical instruments usually contain a limited number of audio channels through which tonal information can be processed. Each channel usually handles multiple waveforms for reasons of economy, since providing a dedicated audio channel for each tone can be very costly.

It is well known in the art of electronic tone generation that generating two or more simultaneous notes in a single audio channel, where the tones have pitches that are the same or very close to the same but whose phases are not synchronized, will result in tone color distortion. This distortion is the result of random phase relationships associated with the combined signals, where some harmonics of the signals may add while others cancel. Specifically, generating more than one non-phase synchronized tone could result in a different sound being created on successive key depressions. Additionally, listening to simultaneously produced non-phase synchronized tones may not sound as one would expect after hearing each sound individually.

An important element of any tone generation system is the tone generator. The development of tone generation systems has evolved in a similar manner to almost all other electronic systems. Specifically, at one point in time electronic instruments were designed and built using analog systems. At that time, tone generators were necessarily built using analog designs. Eventually, however, digital systems were incorporated into electronic musical instruments and therein digital tone generators became commonplace. U.S. Pat. No. 3,610,799 discloses the basic design for digital tone generators. The tone generator uses an accumulator output as a memory address pointer for a memory containing sample waveform information. The information retrieved from the memory is applied to an envelope generator wherein the waveform information is increased or decreased in value to create a pleasant attack and decay.

The frequency of the resultant audio signal from the tone generator is a function of an increment number by which the memory containing the waveform information is indexed. In other words, the increment number determines the amount by which the memory address will be incremented to point to the next desired waveform sample. The larger the increment number used for addressing the waveform data, the higher the resulting audio frequency will be. The multibit accumulator which provides the memory address accepts as an input the increment number which is a numerical value proportional to the desired audio frequency. This numerical value, termed a "frequency number," is related to the depressed key on the musical instrument. In operation, the accumulator outputs a larger number each time it adds the frequency number to the previous sum. This value is used as a memory address for the memory containing the waveform information. The larger the frequency number, the more rapid the accumulation will be and thus the higher the audio frequency will become. Each of the keys on a keyboard has an associated frequency number consistent with the required audio frequency to be produced upon depression of that particular key.

As is well known, in electronic organs as well as pipe organs there are included a plurality of devices called stops. Some of these stops serve to activate various ranks. In pipe organs, a rank is a set of pipes which produce sounds representative of a particular instrument (e.g., flute) or a particular general musical sound for a particular keyboard. When the stop is activated, a particular rank associated with that stop is activated to sound when a key on that keyboard is depressed. A stop may also serve to modify functional characteristics of the keyboard. For example, the stop may require that when a particular key is depressed a sound for a key an octave higher is produced in addition to the sound for to the depressed key. Additionally, a stop could link distinct keyboards of the organ. These types of stops are known as modifier stops. These modifier stops affect the ranks by, for example, linking certain ranks or indicating that the rank should sound when otherwise it would not. In the electronic organ, the rank maintains information about waveform information representative of the sounds a corresponding pipe organ rank would make.

In electronic organs, in order to track the notes for which one desires to generate a sound, the note is described by a combination of parameters. These parameters must indicate at least the particular key which has been struck, on which keyboard the particular key resides, and whether the keyboard has been modified by any stops. One particular scheme for tracking the notes to be generated is to use a key number and a keying group. The key number is a number associated with a particular key position on any of the physical keyboards. A keying group numbers is a number which differentiates notes coming from different physical keyboards or from a key which has been associated with a keyboard in response to a modifier stop being activated.

SUMMARY OF THE INVENTION

The present invention encompasses an apparatus for phase synchronizing tones in an electronic musical instrument comprising a microprocessor having an input for receiving a signal representative of a selected note where upon receipt of the signal, the microprocessor checks a set of available ranks to determine which of the available ranks are associated with the selected note. The apparatus further comprises an oscillator which is established for each rank determined to be associated with the selected note. Each oscillator comprises initializing parameters and initiating parameters which define the selected note and the associated rank. The apparatus further comprises a plurality of tone engines for generating tones. The tone engines are coupled to each oscillator wherein the initializing parameters are transferred from each oscillator to an associated one of the plurality of tone engines and then the initiating parameters are simultaneously transferred from each oscillator to the associated tone engine.

The present invention also provides a method for phase synchronizing tones in an electronic musical instrument comprising the steps of receiving a signal representative of a selected note and monitoring a set of available ranks to determine which of the available ranks are associated with the selected note. Upon determining a rank is associated with the selected note, the present invention establishes an oscillator for each rank determined to be associated with the selected note. The oscillator comprises initializing parameters and initiating parameters for defining a tone representative of the selected note and the associated rank. The initializing parameters are transferred from each established oscillator to an associated tone engine for generating the tone. Thereafter, the initiating parameters are transferred from each established oscillator to the associated tone engine.

DETAILED DESCRIPTION OF THE INVENTION

The present invention will be described in conjunction with the attached figures, wherein like numerals identify like elements. The present invention may be used in conjunction with a variety of electronic musical instruments. The preferred embodiment will be described in the context of an electronic organ. This is intended only for illustrative purposes and not to limit the scope of the invention. The scope of the invention is defined by the appended claims.

Figure 1:
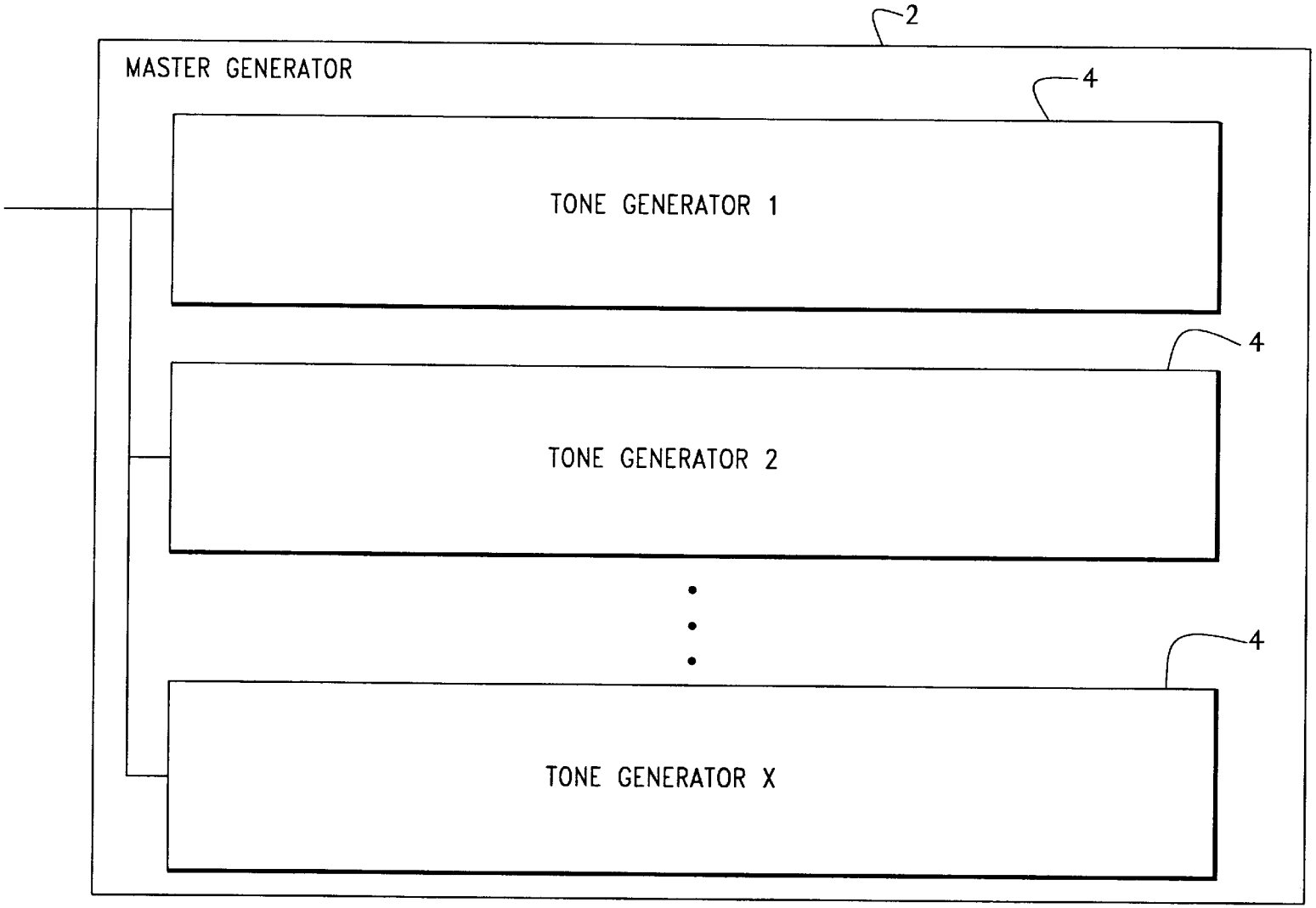
FIG. 1 is a block diagram illustrating a master generator of the present invention.
Figure 2:
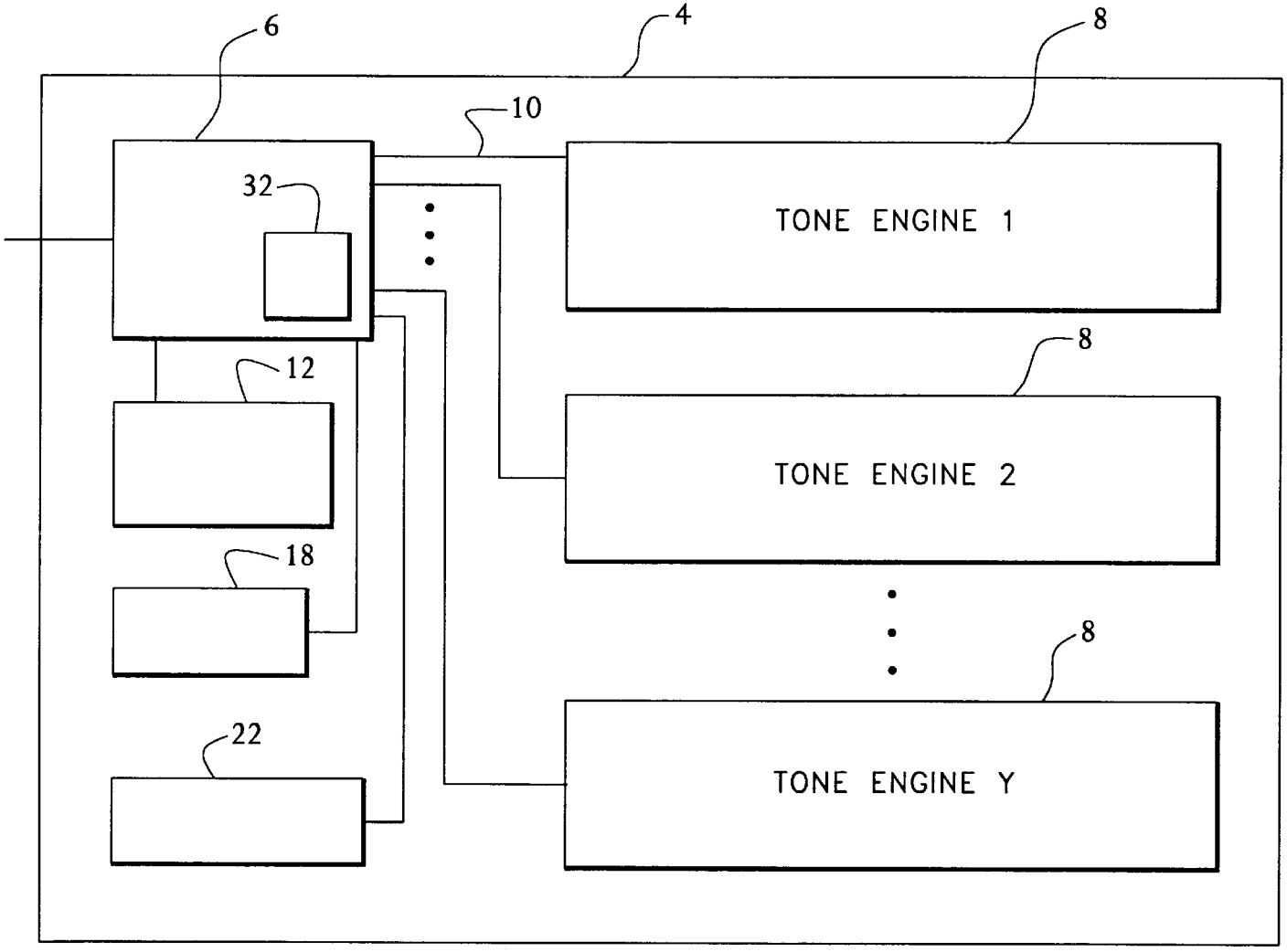
FIG. 2 is a block diagram illustrating a tone generator of the present invention.

The present invention includes a system for generating tones which are phase synchronized. The system includes a master generator 2 which resides in an organ. The master generator 2 includes a plurality of tone generators 4. The number of tone generators 4 included in the master generator 2 is limited only by available hardware and economic considerations. FIG. 2 illustrates a tone generator 4. In general, each of the tone generators 4 illustrated in FIG. 1 are identical. The tone generator 4 of FIG. 2 is merely exemplary of the plurality of tone generators of FIG. 1 and is not meant to be limiting.

The tone generator includes a microprocessor 6. In a preferred embodiment the microprocessor 6 is a Motorola 68332 appropriately programmed for the requirements of the present invention. However, any conventional microprocessor capable of controlling the associated elements described below may be used. The tone generator 4 further includes a plurality of tone engines 8. The number of tone engines 8 is limited only by available hardware and economic considerations. Each tone engine 8 is electrically connected to the microprocessor 6 via electrical conductors 10. The tone generator 4 further includes a rank element 12. The rank element 12 is a memory storage device. The memory storage device can be any one of a random access memory (RAM), a programmable read only memory (PROM), or any similar memory device. In FIG. 2 the rank element 12 is illustrated as a separate element from the microprocessor 6. However, the rank element 12 may be an integral part of the microprocessor 6.

Figure 3:
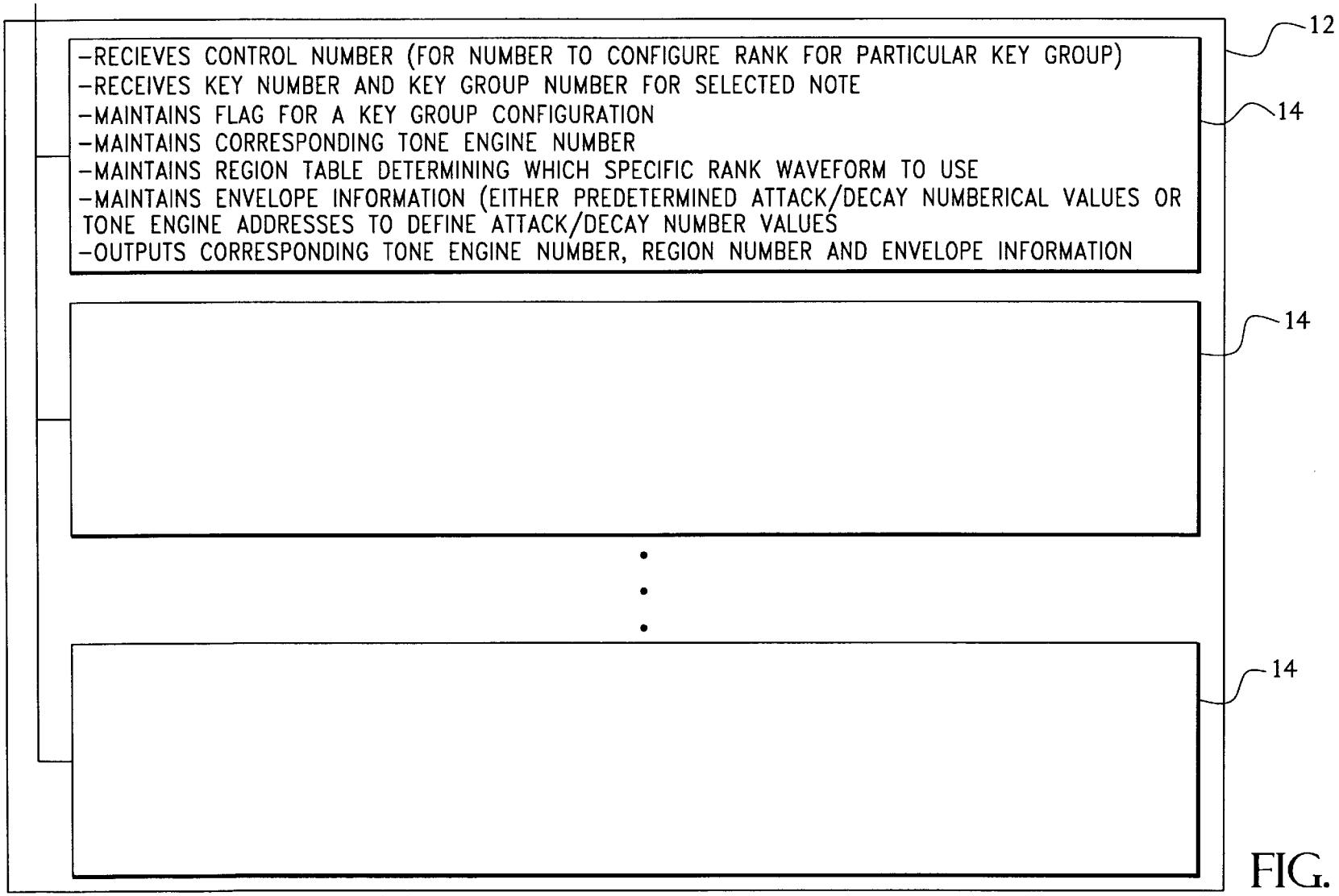
FIG. 3 is a block diagram illustrating a rank element of the present invention.

As illustrated in FIG. 3, the rank element 12 stores information for a plurality of ranks. The individual rank of the rank element 12 is a data structure 14. The rank data structure 14 contains various parameters for a particular rank. The rank data structure 14 includes parameters such as a flag for indicating whether a particular rank is configured for a particular keying group. This flag is set when a stop on the organ is pulled to activate a rank. When the stop is pulled a message is sent to the microprocessor 6 which in turn sets the flag for a particular rank as configured for that particular keying group. The rank data structure 14 further includes region tables which indicate which one of a plurality of specific waveforms representative of the rank is required by a particular key number. The key number is representative of a particular key on the organ keyboard which has been depressed. The key depressed determines which of the plurality of specific waveforms will be used to generate the tone. The rank data structure 14 further includes information indicating which tone engine 8 maintains the particular waveform information for that rank. The rank data structure 14 further includes envelope information regarding the attack and decay of the particular note. This envelope information may be either a predetermined attack/decay in numerical values or an address in the tone engine 8 to define the attack/decay numerical values. The rank data structure 14 may include various other parameters which are used to define the particular rank.

Figure 4:
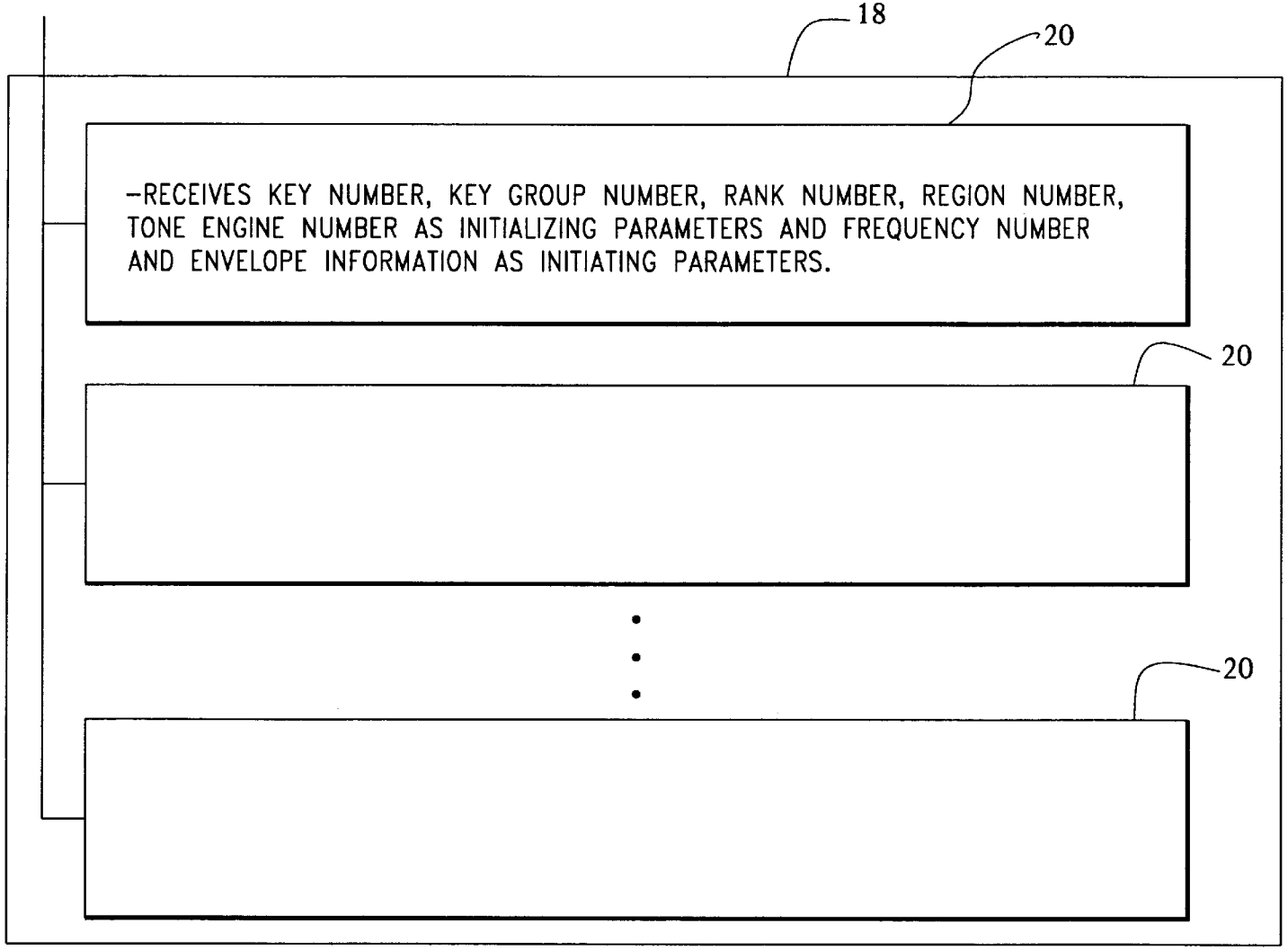
FIG. 4 is a block diagram illustrating an oscillator element of the present invention.

Tone generator 4 further includes an oscillator bank 18. The oscillator bank 18 is a memory element, such as a RAM or similar memory element which is capable of being accessed dynamically and storing information. In FIG. 2, the oscillator bank 18 is illustrated as a individual element. However, the oscillator bank 18 may be an integral part of the microprocessor 6. As illustrated in FIG. 4, the oscillator bank 18 is capable of storing information for a plurality of oscillators. The number of oscillators will depend upon the number of ranks configured to play for a particular note (as discussed below). The oscillator bank 18 includes a plurality of oscillator data structures 20. Each oscillator data structure 20 includes a plurality of parameters related to a particular rank which has been indicated as associated with a selected note and required to be used to produce a particular desired sound. The oscillator data structure 20 includes information detailing which tone engine maintains the particular rank waveform information for the associated rank. The oscillator data structure 20 further includes parameters detailing the envelope information, which specific rank waveform is required for the particular note, a frequency number for the particular note, and which rank is associated with a particular oscillator.

The tone generator 4 also includes a frequency number memory 22. The frequency number memory 22 may be any memory capable of storing a lookup table, for example a ROM. The frequency number memory 22 includes information regarding particular frequency numbers for a particular key number. The frequency number memory 22 also includes the information required to determine which frequency number corresponds to which particular key number. This additional information includes key shift numbering which modifies a particular key to make the key sharper or flatter. The keys are modified in order to add more realistic sounds to their base frequency.

Figure 5:
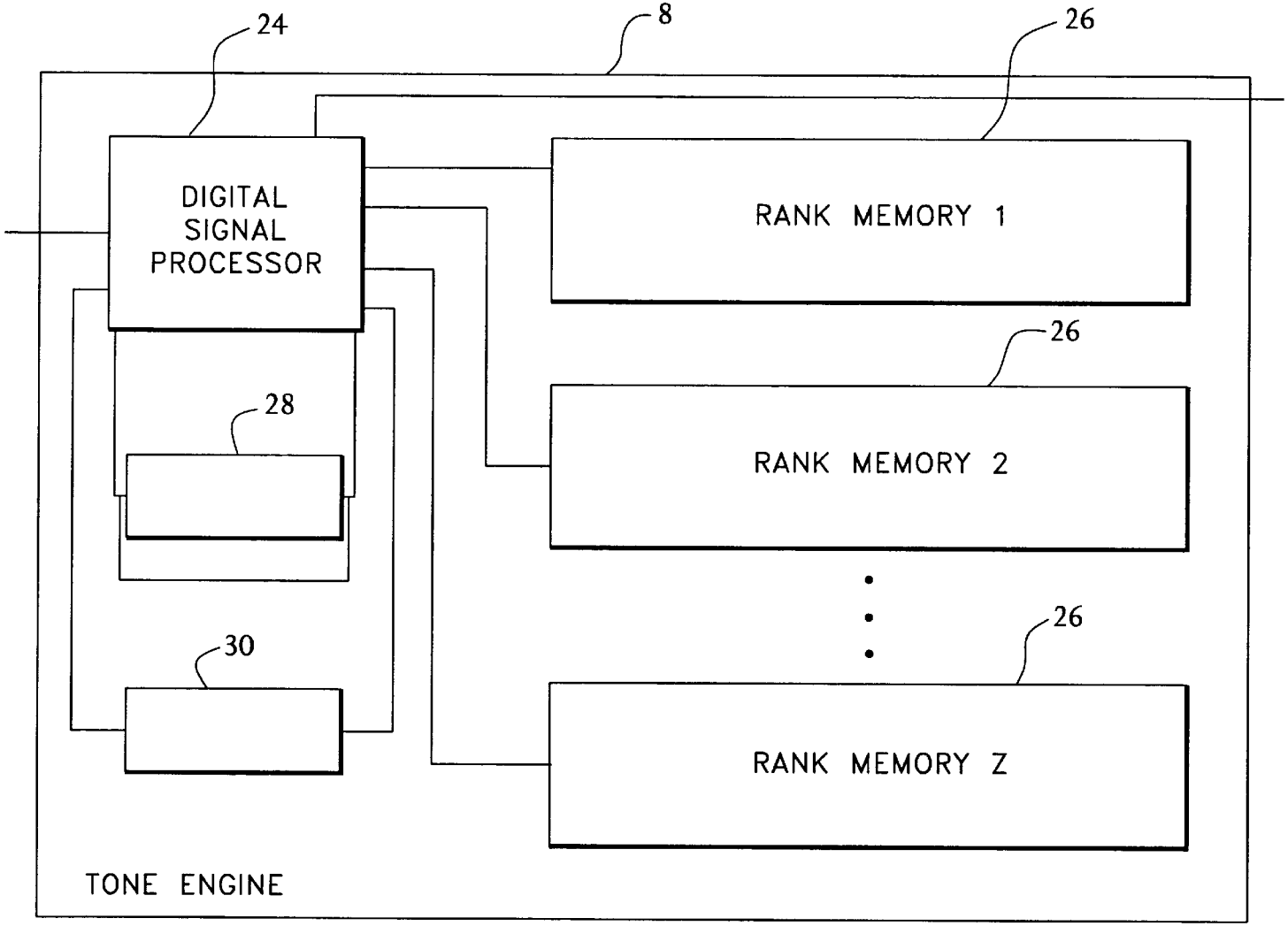
FIG. 5 is a block diagram illustrating a tone engine of the present invention.
Figure 6:
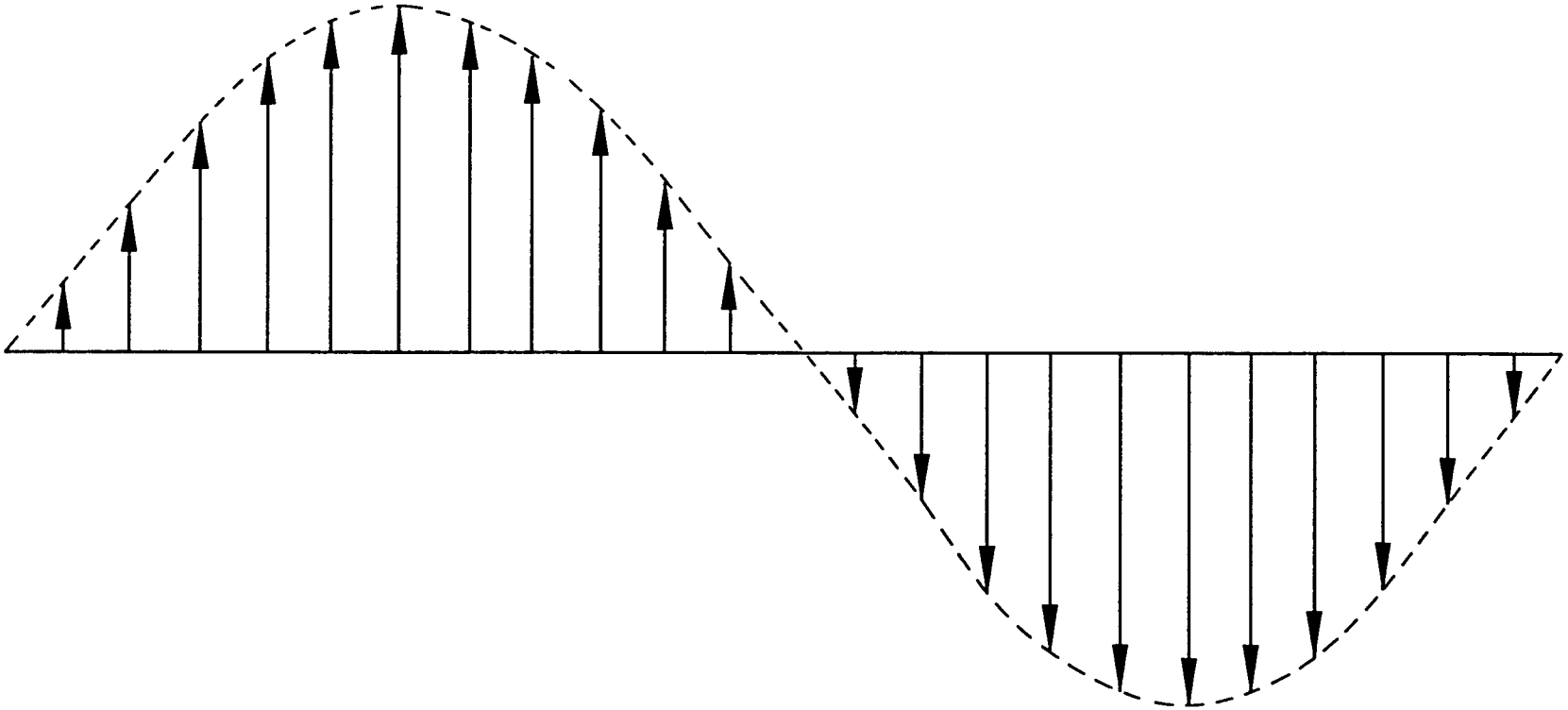
FIG. 6 is an example of a rank waveform used with the present invention.

The tone generator 4 further includes a plurality of tone engines 8. The number of tone engines 8 per tone generator 4 is limited only by available hardware and economic considerations. FIG. 5 illustrates the details of the tone engine 8. The tone engine 8 may be, for example, a digital signal processor (DSP). The DSP may be, for example, a Motorola 56303. Tone engine 8 is programmed to process the necessary information in order to generate the musical sound. The tone engine 8 includes a processor 24 which controls the functions of the tone engine 8. As illustrated in FIG. 5, the tone engine 8 further includes a plurality of rank waveform memories 26. The number of rank memories 26 is limited only by available hardware and economic considerations. This is meant only for illustrative purposes and not to limit the present invention. The rank memories 26 store the specific rank waveform information. The information is stored as a series of discrete samples in digital form. Each sample can be represented graphically as an "amplitude." What is actually stored in the memory is a digital word having a predetermined number of bits representative of the amplitude. FIG. 6 illustrates an example of one complete cycle of a waveform. The waveform closely resembles a sine wave which would sound much like a flute, for example, when converted to an analog signal and applied to a transducer. Each arrow in the FIG. 6 represents one sample. In its digital form it would be associated with the unique address within the rank memory 26. In the example of FIG. 6, there are 24 samples representing one cycle of the waveform. However, in practice there would most likely be many more samples. Each rank memory 26 will include at least one cycle and most likely a plurality of cycles for each rank. These cycles will differ slightly depending upon various factors. These factors include voices for different octaves of the keyboard and information representing a natural attack and decay transient. The plurality of waveforms each have specific memory address in the rank memory 26 in order to address them when necessary for generating the particular tone.

The tone engine 8 further includes a waveform accumulator 28. The waveform accumulator 28 is used to generate the memory address for the particular rank memory 26. The waveform accumulator 28 receives the frequency number from the processor 24 and generates the memory addresses. The tone engine 8 further includes an envelope accumulator 30. The envelope accumulator 30 functions to generate the envelope curves for the selected note. Both the waveform accumulator 28 and the envelope accumulator 30 are represented as individual elements in FIG. 5. However, they may be formed as integral elements of the processor 24.

Figure 7A:
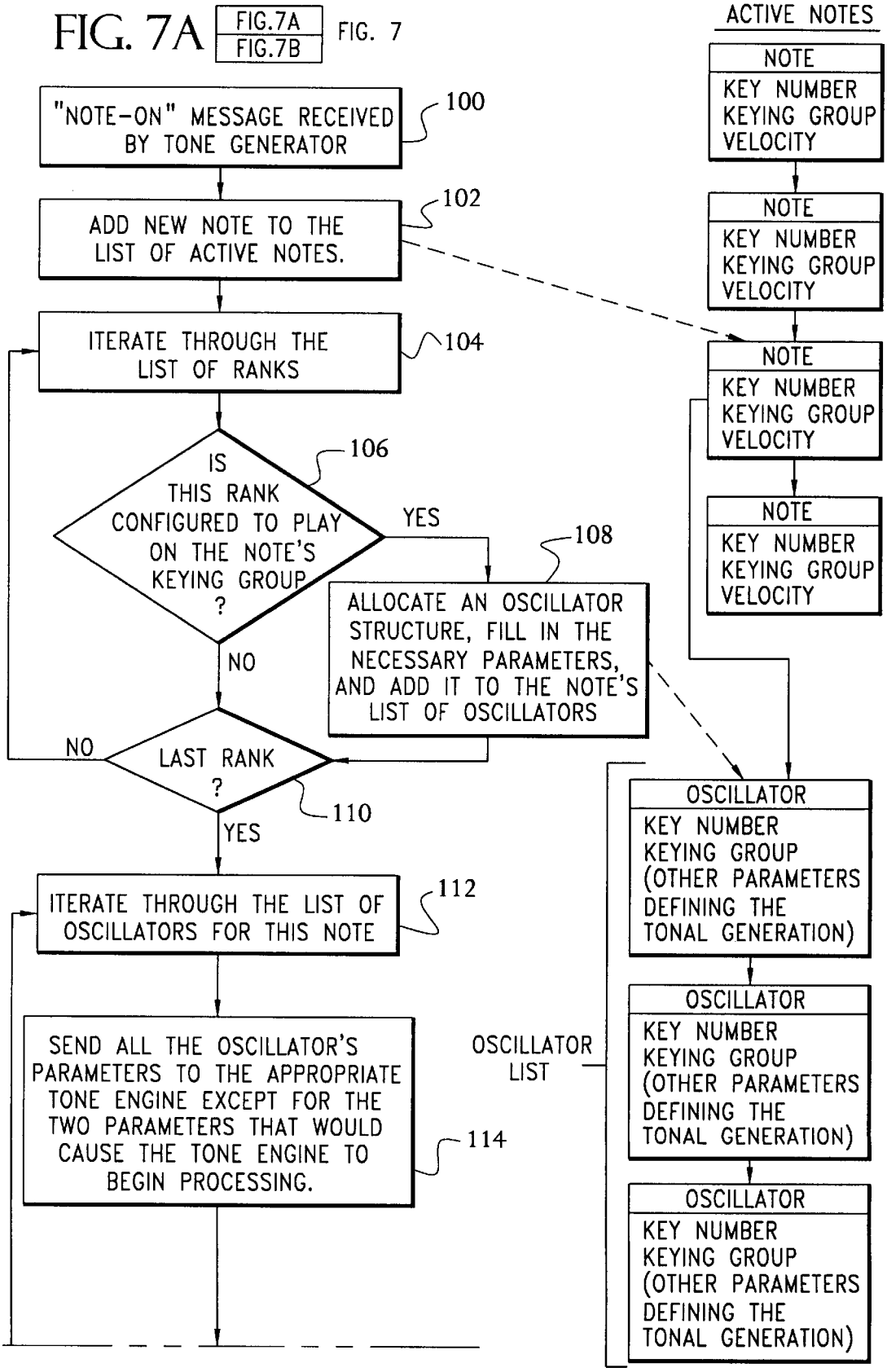
FIG. 7 is a flow chart illustrating an example of the operation of the present invention.
Figure 7B:
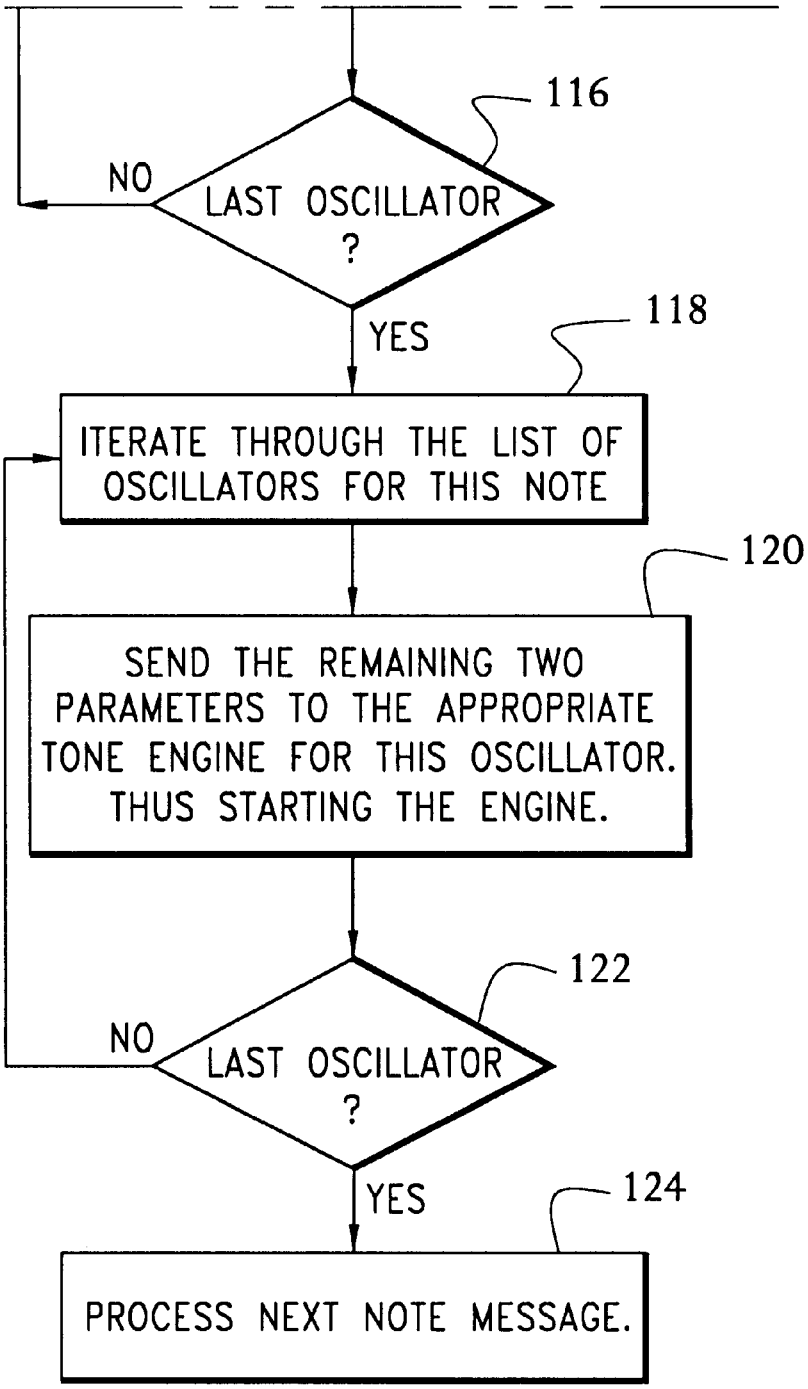

FIG. 7 illustrates a flow chart detailing the operation of the present invention. In operation the master generator 2 will receive signals indicating which stops have been pulled. In response, the master generator 2 passes a stop signal onto each tone generator 4. The tone generator microprocessor 6 receives the stop signal and sets the flag for the appropriate rank data structure 14 in the rank element 12 as configured to play with a particular key group. This stop signal can occur either before a key of an organ keyboard is depressed, while the key is depressed, or after a key is released. Whenever the stop is deactivated a signal is sent to the master generator 2 indicating such a state. The master generator 2 passes the signal onto all of the tone generators 4 which appropriately sets the flag of the rank elements 12.

When a particular key on a organ keyboard is depressed, a "note on" message is developed. The "note on" message includes a signal that a key has been depressed, a key number representing the key position on the keyboard, a keying group number representing which keying group the key is associated with and a number representative of the velocity with which the key was struck. The "note on" message is received by the master generator 2 and the master generator 2 forwards the "note on" message to each individual tone generator 4, as illustrated in 100 of FIG. 7. For purposes of simplicity only, the process of a single tone generator 4 will be explained. However, each individual tone generator 4 executes the same process as described. This description is meant only for illustrative purposes and not to limit the present invention. As shown in step 102, upon receipt of the "note on" message, the tone generator microprocessor 6 of the tone generator 4 establishes an active notes memory section 32 and stores the key number, keying group, and velocity for each note for which it receives a "note on" message. In step 104, the tone generator microprocessor 6 begins to iterate through the rank data structures 14 of the rank element 12. The microprocessor 6 checks the keying group flag of each individual rank data structure 14 to determine if the particular rank is configured to play on the keying group associated with the selected note. If a rank is configured to play on the selected note's keying group, in step 108 the microprocessor 6 allocates an oscillator data structure 20 in oscillator 18. The microprocessor 6 transfers rank data structure information to the oscillator data structure including which tone engine contains the waveform information for the particular rank, envelope information, the specific rank waveform associated with the key number and the particular rank. The oscillator also receives information from the microprocessor 6 including the key number and the keying group. Once the oscillator data structure has been established, in step 110 the process determines if the last rank in the rank element memory 12 has been checked. If the last rank has not been checked, the process returns to step 104 where the next rank is checked to determine if it is configured to play on the selected note's keying group. Once the last rank has been checked then a complete list of oscillator data structures 20 has been established in oscillator 18. The oscillator data structure 20 includes initializing parameters and initiating parameters. The initializing parameters includes those parameters which when sent to a tone engine 8 will not initiate the tone engine. The initiating parameters include those parameters which when sent to the tone engine 8 will initiate the tone engine 8 and generate a particular tone. The initializing parameters include key number, keying group, which particular rank is to be played, which specific rank waveform is to be played and any other parameter stored in the oscillator which when sent to the tone engine will not initiate the tone engine. The initiating parameters include frequency number and the envelope information. Prior to receiving the initiating parameters, the waveform accumulator 28 will be in a non-active state. In other words, the waveform accumulator will not be producing any output changes with time and therefore will note provide memory addresses of a particular rank. Further, the envelope generator 30 will be in a zero amplitude state. As such, any waveform which would be generated would be multiplied by zero and thereby produce no actual output. In this particular embodiment the envelope generator is initially set to zero and resets to zero necessarily at the end of a prior decay.

Once all the required oscillator data structures 20 have been established in the oscillator 18, the tone generator microprocessor 6 begins an iteration through the list of oscillator data structures 20 in step 112. In step 114 the microprocessor 6 forwards all the initializing parameters to the appropriate tone engine in accordance with the information stored in the oscillator data structure 20. Once the initializing parameters for the particular oscillator data structure 20 have been forwarded to a tone engine 8, in step 116 the microprocessor 6 determines if the last oscillator structure has been checked. If the last oscillator structure 20 has not been checked, the microprocessor goes to the next oscillator data structure 20. Once the last oscillator data structure has been checked and the initializing parameters forwarded to a tone engine, in step 118 the microprocessor begins a second iteration through the oscillator data structure 20. In this iteration, in step 120, the microprocessor 6 forwards the initiating parameters to the appropriate tone engine 8 for the particular oscillator data structure 20. In step 122, the microprocessor then determines if the last oscillator data structure 20 has been checked for forwarding the initiating parameters to the tone engine 8. If the last oscillator data structure 20 has not been checked, the microprocessor 6 goes to the next oscillator data structure 20. Once the last oscillator data structure 20 has been checked, in step 124, the microprocessor 6 begins the process for the next selected note.

In response to step 114, the tone engine processor 24 receives the initializing parameters. Upon receipt of the initializing parameters the processor 24 establishes a data structure for the particular rank 26 for which it received information. As part of this data structure the processor 24 knows which rank 26 it is to take waveform information from, and which specific waveform of the rank it is to use to generate the tone. The processor 24 is now prepared to generate the new required tone and will be able to do so upon receipt of the initiating parameters.

In step 120 the initiating parameters are forwarded to the appropriate tone engines 8. This is achieved by forwarding the frequency number to the tone engine 8 processor 24 which in turn forwards the frequency number to the waveform accumulator 28. Once the waveform accumulator 28 receives the frequency number it starts to generate specific waveform memory addresses. Additionally, the envelope information is forwarded to the processor 24 which enables the envelope accumulator 30 to develop the attack/decay curve. The fact that the tone engines have been prepared with the initializing parameters and only require the initiating parameters to begin generating the necessary tones allows all of the necessary tone engines to generate the tones in-phase with each other for each selected note. In other words, the minimal time it takes for the tone generator microprocessor 6 to iterate through the oscillator data structures 20 and forward the initiating parameters to the appropriate tone engine 8 allows each necessary tone engine 8 to generate a tone which is phase synchronized with the other tone engines which are producing a tone for the same note. As such, the various tones which are produced for the selected note are all generated in-phase.

The tone engine provides output information representative of a tone for the selected note in the associated rank simultaneously with any other ranks associated with the selected note. The tone engine receives information from an oscillator including frequency number, rank selection, rank waveform selection (from the region table based upon the key number), envelope parameters (either specific predetermined numerical values or an address in the rank waveform information defining numerical values for attack/decay).

In step 120 the frequency numbers are sent sequentially from the oscillator to the appropriate tone engine as close in time to each other as the hardware will allow so that for all practical purposes they arrive simultaneously. This causes all of the active oscillators to begin to function in-phase.

The present invention may be embodied in other specific forms without departing from the spirit or essential attributes thereof and, accordingly, reference should be made to the appended claims, rather than to the foregoing specification, as indicating the scope of the invention.

I claim:

1. A method for phase synchronizing tones in an electronic musical instrument comprising the steps of:

receiving a signal representative of a selected note;

monitoring a set of available ranks;

determining which of the available ranks are associated with the selected note;

defining an oscillator for each rank determined to be associated with the selected note by reading initializing parameters and initiating parameters for defining a tone representative of the selected note and the associated rank into the oscillator;

transferring the initializing parameters from each established oscillator to an associated tone engine for generating the tone; and after transferring the initializing parameters, transferring the initiating parameters from each established oscillator to the associated tone engine for generating the tone.

2. A method as set forth in claim 1, further comprising the step of simultaneously generating tones in accordance with the oscillator parameters of each established oscillator in response to receipt of the initiating parameters.

3. A method as set forth in claim 1, wherein the signal representative of the selected note includes parameters which define the note.

4. A method as set forth in claim 3, further comprising the step of receiving multiple signals representative of multiple selected notes and establishing a notes list which maintains active notes and their corresponding parameters.

5. A method as set forth in claim 1, further comprising the step of receiving signals which associate the available ranks with various keying groups.

6. A method as set forth in claim 1, further comprising the step of undefining the oscillator once the initiating parameters have been transferred to the associated tone engine.

7. A method as set forth in claim 1, wherein the step of determining which available ranks are associated with the selected note is achieved by iterating through the available ranks.

8. A method as set forth in claim 1, wherein the initializing parameters include a keys number, a key group number, a rank number, a region number, and a tone engine number.

9. A method as set forth in claim 1, wherein the initiating parameters include a frequency number and envelope information.

10. An apparatus for phase synchronizing tones in an electronic musical instrument comprising:

a microprocessor having an input for receiving a signal representative of a selected note and in response to receipt of the signal the microprocessor checks a set of available ranks to determine which of the available ranks are associated with the selected note;

an oscillator defined for each rank determined to be associated with the selected note, each oscillator comprising initializing parameters and initiating parameters defining a tone representative of the selected note and the associated rank; and a plurality of tone engines for generating tones, the plurality of tone engines coupled to each oscillator wherein the initializing parameters are transferred from each oscillator to an associated one of the plurality of tone engines and then the initiating parameters are simultaneously transferred from each oscillator to the associated tone engine.

11. An apparatus as set forth in claim 10, wherein the signal representative of the selected note includes parameters which define the note.

12. An apparatus as set forth in claim 11, wherein the microprocessor receives multiple signals representative of multiple selected notes and establishes a notes list which maintains active notes and their corresponding parameters.

13. An apparatus as set forth in claim 10, wherein the tone engine maintains waveform information corresponding to various ranks.

14. An apparatus as set forth in claim 10, wherein the initializing parameters include a key number, a keying group number, a rank number, a region number, and a tone engine number.

15. An apparatus as set forth in claim 10, wherein the initiating parameters include a frequency number and envelope information.

* * * * *

UNITED STATES PATENT AND TRADEMARK OFFICE
CERTIFICATE OF CORRECTION

Patent No.: 5,945,620

Dated: August 31, 1999

Inventor(s): John P. Adamson

It is certified that error appears in the above-identified patent and that said Letters Patent is hereby corrected as shown below.

Column 2, line 56, after "A keying group" delete numbers;

Column 7, line 2, after "and therefore will" change "note" to - - not - -

Claim 8, Column 7, line 61 after "parameters include a" change "keys" to - - key - - ;

In Figure 3, box 14, change "recieves" (first occurrence) to - - receives - -;

In Figure 3, box 14, line 6 after "attack/decay" change "numberical" to - - numerical - - .

Signed and Sealed this

Twenty-first Day of March, 2000

*Attest:*

*Attesting Officer*

Q. TODD DICKINSON

*Commissioner of Patents and Trademarks*